US007510407B1

(12) United States Patent
Blasko et al.

(10) Patent No.: US 7,510,407 B1
(45) Date of Patent: Mar. 31, 2009

(54) TOP MOUNT FILTERED HEADER ASSEMBLY

(75) Inventors: Raymond J. Blasko, Boardman, OH (US); Dominic A. Messuri, Canfield, OH (US); Peter M. Politsky, Warren, OH (US); Christopher A. Margrave, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/001,308

(22) Filed: Dec. 11, 2007

(51) Int. Cl.
*H01R 12/00* (2006.01)

(52) U.S. Cl. ..... 439/79; 439/76.1; 439/620.1

(58) Field of Classification Search ..... 439/76.1, 439/79, 620.09, 620.1, 620.15, 620.16, 620.21, 439/620.22
See application file for complete search history.

(56) References Cited

U.S. PATENT DOCUMENTS 5,364,293 A * 11/1994 Peterson ..... 439/620.1
5,507,655 A 4/1996 Goerlich
6,413,119 B1 7/2002 Gabrisko, Jr. et al.
6,527,587 B1 * 3/2003 Ortega et al. ..... 439/608
2001/0010978 A1 8/2001 Paagman
2001/0012730 A1 8/2001 Ramey et al.
2002/0192988 A1 12/2002 Droesbeke et al.

* cited by examiner

*Primary Examiner*—Khiem Nguyen
(74) *Attorney, Agent, or Firm*—David P. Wood

(57) ABSTRACT

A filtered electrical connection header assembly for an electrical device, and methods for assembling a filtered connection header assembly for an electrical device, are disclosed. An electrical connection header may include a housing for an electrical circuit and a connection header assembly secured to the housing that includes a plurality of electrical pins. The pins may each include a first portion, and a second portion oriented generally orthogonal to the first portion. The second portions of the pins extend into the housing to contact the electrical circuit. A forward end of a connector shroud may receive a pin stabilizer having a plurality of apertures that receive the first portion of the pins for engagement with a mating connector. The electrical connection header may further include a filter assembly configured to filter a signal transmitted though the pins that is secured to the external surface of the housing.

19 Claims, 5 Drawing Sheets

TOP MOUNT FILTERED HEADER ASSEMBLY

BACKGROUND

Printed circuit boards (PCBs) are used in a wide variety of electronic devices including household appliances, motor vehicles, computers, and even children's toys. The PCBs are generally mounted within a housing that protects the PCB and facilitates installation into a particular application. In most cases, the PCB is connected to the electronic devices through a plug-in and mating connector combination that attaches to the PCB through an opening in the housing. The plug-in connector includes a plurality of wires or "pins" that extend between the mating connector and the PCB. The PCB may thus be integrated into the electrical device as a modular component and easily installed or removed for service or replacement by connecting or disconnecting the plug-in connector. Further, a filter may be provided to reduce electrical noise or interference with signals transmitted through the pins that may be caused by external electromagnetic fields, e.g., other electrical devices in the vicinity of the PCB. In one example, an electrical system for a motor vehicle employs a PCB housed within an aluminum casting and mounted on an interior surface of the vehicle. A plug-in connection header is assembled as part of the housing to allow the mating connector to interface with the PCB. The housing thus generally protects the PCB from contaminants and damage, while the connection header provides a reliable electrical connection for the transmission of a filtered signal between the electrical system and the PCB.

In known configurations, filtering mechanisms are secured within a housing, generally adjacent a PCB. Generally straight contact pins extend vertically from the PCB and filter within the housing to a connection header that receives a mating connector. The generally straight pins result in a relatively tall connection header assembly, especially when the mating connector is secured to the connection header. Further, the filtering devices must generally be secured within the housing to provide adequate protection from external contaminants and/or shock and vibration that may occur during use of the device, resulting in a relatively tall housing. Rearrangement of the filter and/or contact pins generally results in even more complex assemblies that are not practical for assembling in a mass manufacturing setting.

Accordingly, there is a need in the art for a filtered connection header, which provides a lower profile to minimize space in the housing while still allowing for efficient assembly.

SUMMARY

Various examples of a filtered electrical connection header assembly for an electrical device, and methods for assembling a filtered connection header assembly for an electrical device, are disclosed herein. An illustrative example of an electrical connection header includes a housing defining an interior volume for an electrical circuit, and an external surface adjacent the interior volume. The electrical connection header further includes a connection header assembly secured to the housing, including a plurality of electrical pins. The pins each include a first portion, and a second portion oriented generally orthogonal to the first portion. The second portions of the pins extend into the interior volume of the housing to contact the electrical circuit. The electrical connection header further includes a filter assembly configured to filter a signal transmitted though the pins that is secured to the external surface of the housing.

Another example of an electrical connection header includes a housing configured to receive an electrical circuit and a connection header assembly secured to the housing. The connection header includes a plurality of electrical pins, each including a first portion and a second portion oriented generally orthogonal to the first portion of the pins. The second portion of the pins extend through the housing for contacting the electrical circuit. The connection header further includes a connector shroud secured to the housing. A forward end of connector shroud receives a pin stabilizer having a plurality of apertures that receive the first portion of the pins for engagement with a mating connector at the forward end of the connector shroud.

An illustrative example of a method for assembling a filtered connection header may include providing a housing for an electrical circuit, and providing a plurality of pins having first portions and second portions oriented generally orthogonally to the first portions. The method may further include inserting the first portion of the pins into an inner pin stabilizer, securing the pins to the housing and inserting the inner pin stabilizer into a connector shroud.

BRIEF DESCRIPTION OF THE DRAWINGS

While the claims are not limited to the illustrated examples, an appreciation of various aspects is best gained through a discussion of various examples thereof. Referring now to the drawings, illustrative examples are shown in detail. Although the drawings represent the various examples, the drawings are not necessarily to scale and certain features may be exaggerated to better illustrate and explain an innovative aspect of an example. Further, the examples described herein are not intended to be exhaustive or otherwise limiting or restricting to the precise form and configuration shown in the drawings and disclosed in the following detailed description. Exemplary illustrations of the present invention are described in detail by referring to the drawings as follows.

DETAILED DESCRIPTION

A plug-in connector for an electrical device is provided. The plug-in connector generally includes a filtered connection header secured to a housing. The filtered connection header may include a plurality of pins that are angled, e.g., at a right angle, to provide a relatively low profile. The connection header further includes a filter assembly secured to an external surface of the housing, e.g., adjacent an internal volume of the housing that receives an electrical device in contact with the pins, thereby allowing for simplified assembly of the filter assembly to the housing. The filtered connection header may also include a pin stabilizer assembly receiving the pins for alignment or positioning for engagement with a mating connector. The pin stabilizer assembly includes an inner pin stabilizer that may be assembled to the pins. The pin stabilizer assembly may further include an outer pin stabilizer that is inserted into a forward end of the connection header to receive the inner pin stabilizer. The inner pin stabilizer thus generally aligns the pins for insertion to the outer pin stabilizer.

Figure 1B:
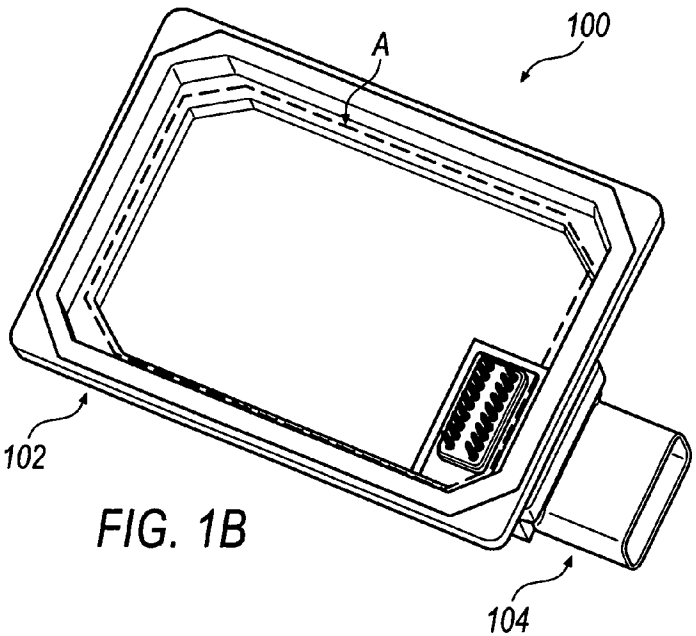
FIG. 1B is a bottom perspective view of an exemplary filtered connection header assembled with a housing, with a bottom panel removed.
Figure 1A:
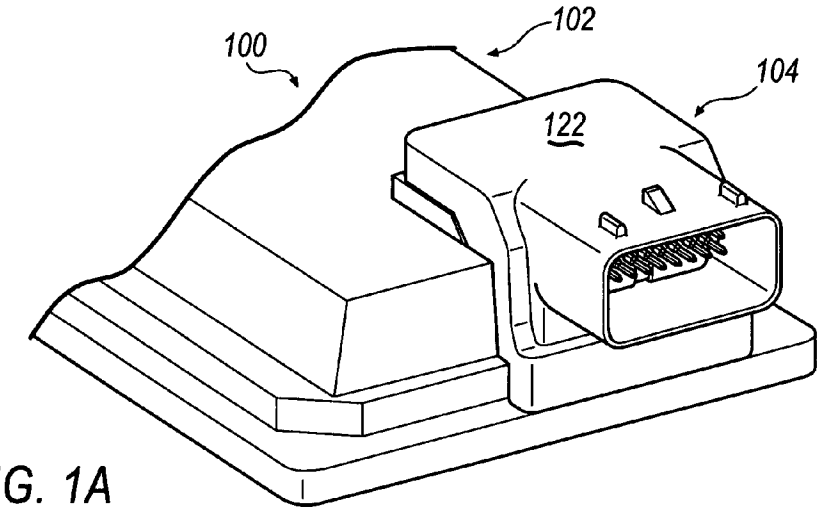
FIG. 1A is an elevated perspective view of an exemplary filtered connection header assembled with a housing.
Figure 2:
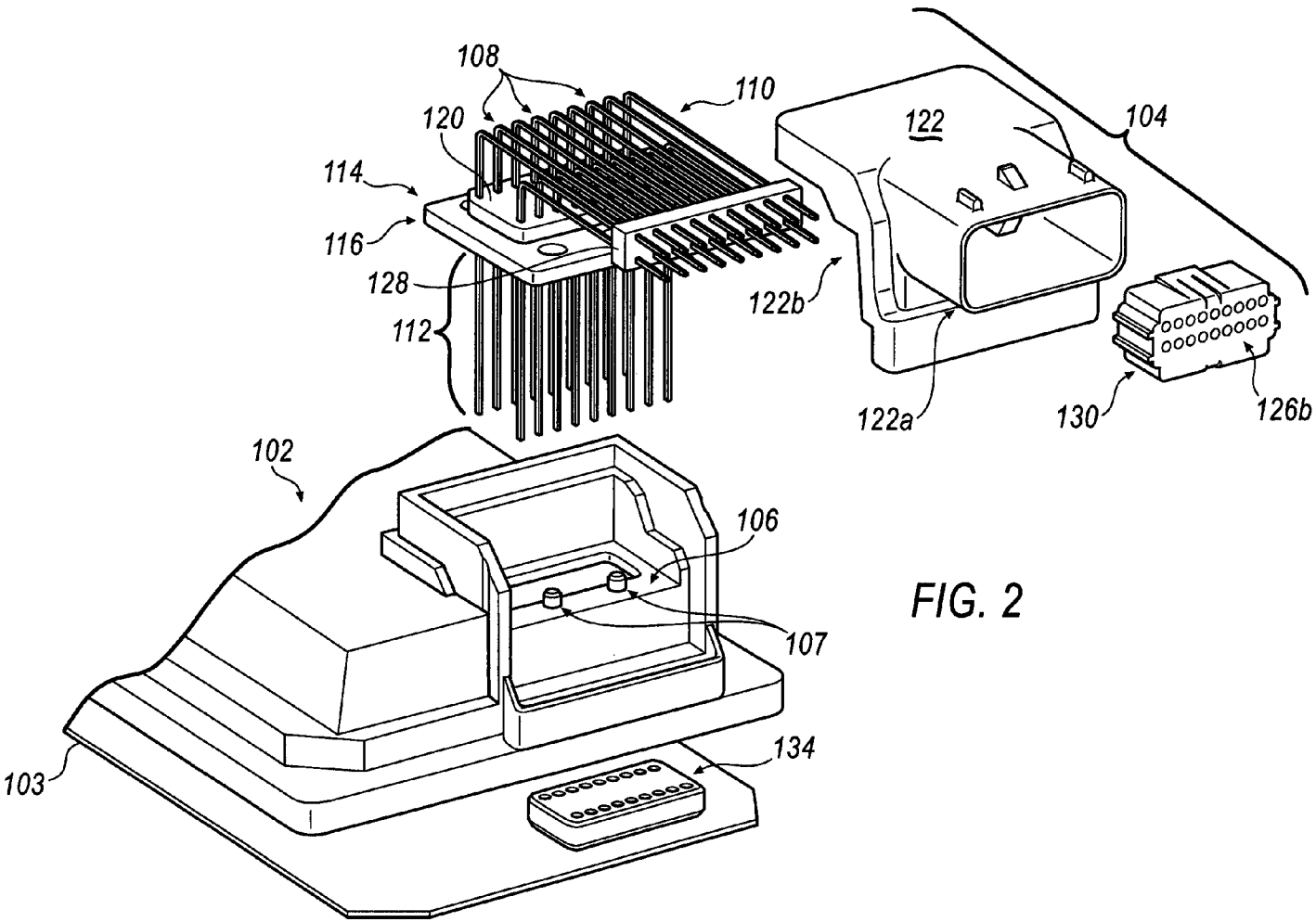
FIG. 2 is an exploded perspective view of an exemplary filtered connection header and housing.
Figure 3:
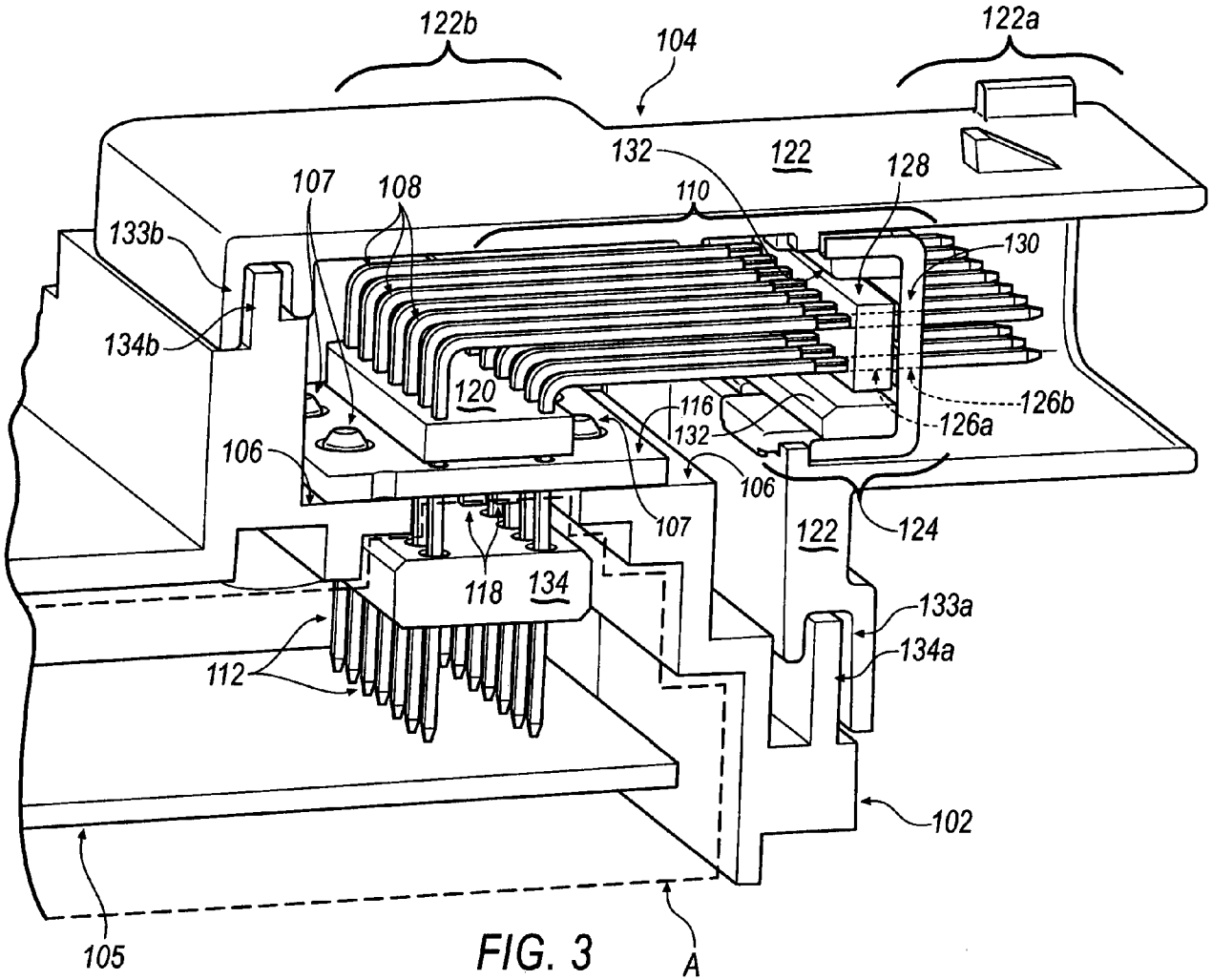
FIG. 3 is a cutaway perspective view of an exemplary filtered connection header and housing assembly.

Turning now to FIGS. 1-3, an exemplary device 100 is illustrated including a housing 102 and a connection header assembly 104 secured to the housing 102. FIG. 1B and FIG. 3 each illustrate an interior of housing 102, which defines a generally enclosed or otherwise interior volume A. Housing 102 is generally configured to receive an electrical circuit, e.g., a printed circuit board 105, within interior volume A. An external surface 106 is provided adjacent the interior volume A. Housing 102 may be formed of a conductive material, e.g., die-cast aluminum thereby forming at least part of a filtering circuit of the device 100, as further described below. Housing 102 may be generally enclosed about interior volume A with a bottom panel 103 (see FIG. 2, an exploded view of housing 102 and connection header assembly 104), thereby protecting PCB 105 or any other electrical devices or features enclosed within housing 102, e.g., within interior volume A. Further, as described below, housing 102 may be generally sealed, at least about interior volume A, to generally protect PCB 105 or any other devices or features enclosed therein from external contaminants, e.g., moisture, dirt, etc.

As best illustrated in FIGS. 2 and 3, a connection header assembly 104 is secured to the housing 102. Connection header assembly 104 generally includes a plurality of electrical pins 108, a filter assembly 114 receiving the plurality of pins, and a connector shroud 122 that is secured to the housing 102. The connector shroud 122 generally encloses and seals the pins, an interface between the pins, and the PCB 105 contained within housing 102, as will be further described below. Electrical pins 108 include a first portion 110 and a second portion 112 that is angled in relation to the first portion 110, in order to reduce an overall profile or height of device 100. Further, the second portion 112 may be oriented generally orthogonal to the first portion 110 in order to provide as low a profile as possible for device 100. In other words, pins 108 may define an angle of approximately 90 degrees. As the overall height of device 100 is dictated at least in part by the vertical extension of the first portions 110 of pins 108, a 90-degree orientation minimizes the overall height or profile of device 100. The first portion 110 generally extends through connector shroud 122 for engagement with a mating connector (not shown) at a forward end 122*a* of the connector shroud 122. Second portion 112 of pins 108 generally extends downward from connector shroud 122 and into housing 102 to engage the PCB 105, or any other electrical circuit or device. Accordingly, electrical pins 108 generally allow for communication between a mating connector (not shown) and an electrical device, e.g., PCB 105, contained within housing 102.

Pins 108 may be secured to housing 102 with a filter assembly 114. Filter assembly 114 is generally configured to filter electrical signals transmitted through pins 108. For example, as shown in FIGS. 2 and 3, filter assembly 114 may include a circuit board 116 and at least one capacitor 118 mounted on the circuit board 116. Circuit board 116 may be secured to external surface 106 of housing 102 with grounding posts 107, which provide an electrical ground for the circuit board 116, as described further below. Apertures may be provided in circuit board 116 that receive grounding posts 107, thereby securing circuit board 116 to housing 102 and/or external surface 106. Filter assembly 114 generally receives the second portion of pins 108, thereby retaining pins 108 to the housing 102 and filtering the signal transmitted therethrough. Pins 108 extend through filter assembly 114 and into interior volume A of housing 102 for engagement with PCB 105 within housing 102. Filter assembly 114 may be generally sealed to housing 102, e.g., at an interface between filter assembly 114 and housing 102, as will be described further below. Filter assembly 114 is advantageously secured to external surface 106 of housing 102 that is disposed outside of the interior volume A. Accordingly, pins 108 may be assembled to filter assembly 114 and then subsequently assembled to housing 102 from outside housing 102, as will be described further below. Furthermore, capacitors 118, as best seen in FIG. 3, may be surface mounted, e.g., by soldering, on an underside of circuit board 116 such that capacitors 118 are generally disposed within interior volume A of housing 102. Accordingly, capacitors 118, which are typically formed of a ceramic material or are otherwise particularly fragile or delicate, are generally protected from being damaged or disengaged from circuit board 116. Further, capacitors 118 may be provided at a generally center portion of circuit board 116, generally within interior volume A, thereby spacing capacitors 118 as far away as possible from the interface between circuit board 116 and housing 102 to reduce damage that may occur during assembly of device 100, e.g., installation of circuit board 116 to housing 102, or installation of ferrite block 134, as further described below. Capacitors 118 are generally in electrical communication with circuit board 116, and are grounded via grounding posts 107. More specifically, an electrical ground path may be provided from the capacitors to a ground plane in the circuit board 116, and then to conductive apertures or slots of circuit board 116, and finally to grounding posts 107 by way of a press-fit interface between grounding posts 107 and apertures defined in circuit board 116. Grounding posts 107 may be grounded externally by way of housing 102, which is generally in electrical communication with grounding posts 107. In this way, housing 102 completes the grounding circuit from the circuit board 116 where it is formed from a conductive material such as aluminum. As best shown in FIG. 3, the capacitors 118 may be secured to circuit board 116 generally between the rows of pins 108, furthest away from the press-fit connection between circuit board 116 and grounding posts 107, thereby reducing damage that may occur to capacitors 118 when circuit board 116 is secured to housing 102 as a result of strain induced in circuit board 116 during the press-fit assembly process. Additionally, filter assembly 114 may be assembled from an upper side of housing 102 and secured directly to external surface 106, and need not be inserted through an aperture of the housing 102. Filter assembly 114 may further include a pin block 120 that receives the second portion of pins 108 and generally aligns the second portions of pins 108 for engagement and/or extension through circuit board 116. For example, pins 108 may be assembled to pin block 120 prior to assembly of the pins 108 to circuit board 116. Accordingly, filter assembly 114, including circuit board 116, pin block 120, and pins 108, may be assembled as a separate assembly of device 100, and then assembled to housing 102.

As briefly described above, connector shroud 122 is secured to housing 102 and receives the first portions 110 of pins 108. Connector shroud 122 generally positions or aligns first portions 110 of pins 108 for engagement with a mating connector (not shown) at a forward end 122*a* of connector shroud 122. As will be described further below, connector shroud 122 receives the pins from a rearward end 122*b* of the connector shroud 122.

Figure 4:
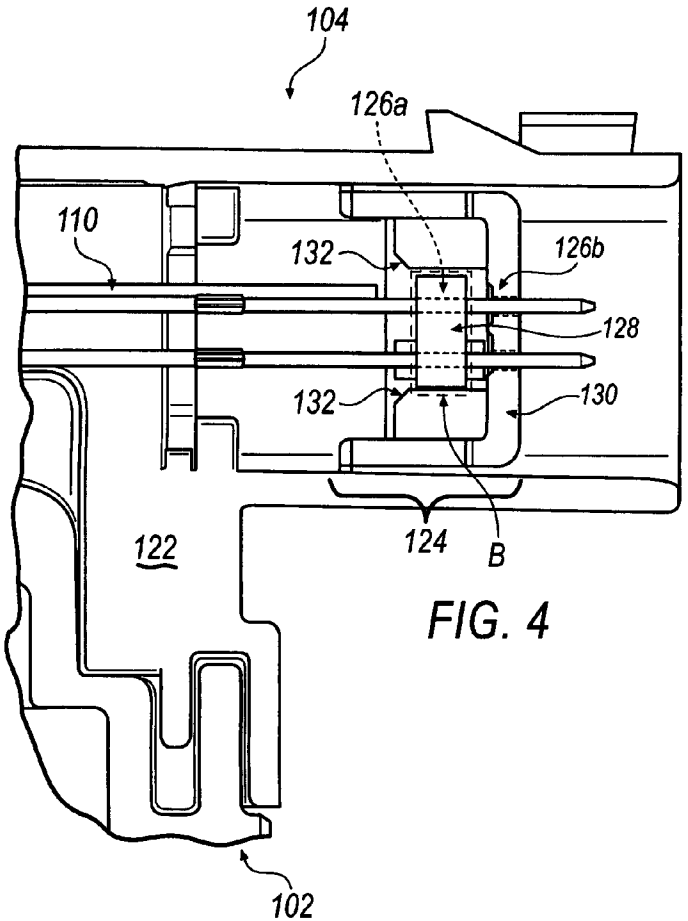
FIG. 4 is a cutaway view of an exemplary filtered connection header during assembly.

Turning now to FIGS. 3 and 4, each of which illustrate a partial cutaway view of connection header assembly 104, connector shroud 122 includes a pin stabilizer assembly 124 that generally receives first portion 110 of pins 108 and aligns pins 108 in a forward end 122*b* of the connector shroud 122. Pin stabilizer assembly 124 may include a plurality of apertures 126 receiving the first portion of pins 108. Pin stabilizer assembly 124 is generally received through forward end 122*a* of connector shroud 122. Pin stabilizer assembly 124 includes an inner stabilizer 128 defining first apertures 126*a* for receiving pins 108. Pin stabilizer assembly 124 further includes an outer stabilizer 130 that receives the inner stabilizer 128 and has a plurality of second apertures 126*b* for receiving pins 108. First and second apertures 126*a*, 126*b* of the inner and outer pin stabilizers 128, 130 thus cooperate to define apertures 126, thereby retaining and aligning first portions 110 of pins 108 in the forward end 122*a* of connector shroud 122. The outer stabilizer 130 is secured at said forward end 122*a* of connector shroud 122, and may advantageously be inserted into the forward end 122*a* of connector shroud 122 and secured within connector shroud 122, e.g., with friction fit features or one or more locking arms (not shown), after connector shroud 122 is secured to housing 102, as will be further described below.

As best shown in FIG. 4, one of the inner stabilizer 128 and outer stabilizer 130 may include an alignment surface that is configured to align the inner stabilizer 128 with outer stabilizer 130 when the outer stabilizer 130 is inserted into the connector shroud 122, as will be described further below. For example, an alignment surface 132 may be a generally angled, e.g., approximately 45 degrees relative to the direction of insertion of the outer stabilizer 130. Accordingly, the alignment surface 132 may engage a corner of the inner stabilizer 128 as outer stabilizer 130 is inserted into connector shroud 122, thereby guiding the inner stabilizer 128 into a cavity B of outer stabilizer 130. Inner stabilizer 128 generally aligns first portions 110 of pins 108, guiding their insertion into second apertures 126*b* of outer stabilizer 130, while the alignment surface 132 of outer stabilizer 130 generally guides inner stabilizer 128 into cavity B. Accordingly, misalignment or jamming of the pins 108 with the outer stabilizer 130 is prevented. Although the alignment surface 132 is described herein as being provided on outer stabilizer 130, the alignment surface 132 may alternatively be provided on inner stabilizer 128. Further, although the angle defined by the alignment surface 132 is described herein as being approximately 45 degrees, any angle may be employed that generally guides inner stabilizer 128 into outer stabilizer 130.

As seen in FIGS. 3 and 4, a ferrite block 134 may be secured to the second portion 112 of pins 108 and be generally disposed within interior volume A of housing 102. Ferrite block 134 generally provides additional filtering of electrical signals transmitted through pins 108.

Figure 5:
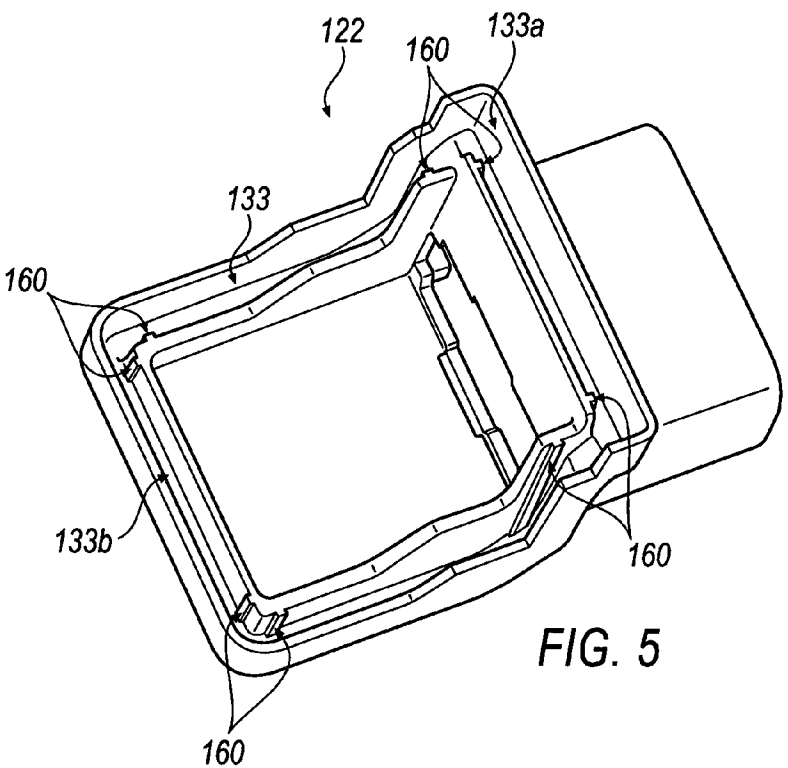
FIG. 5 is a bottom perspective view of an exemplary connector shroud.

As briefly described above, connector shroud 122 is secured to housing 102. For example, as best seen in FIG. 3, connector shroud 122 includes a groove 133 that mates with a tongue of housing 102. More specifically, connector shroud 122 includes a forward groove 133*a* that receives a forward tongue 134*a* of housing 102 when connector shroud 122 is lowered onto housing 102 during assembly. Further, connector shroud 122 includes a rearward groove 133*b* that receives a rearward tongue 134*b* of housing 102 when connector shroud 122 is lowered onto housing 102 during assembly. An adhesive or sealant (not shown) may be provided in groove 133 or upon tongue 134 to generally seal the interface between the PCB 105 and/or connection header assembly 104 and/or the mating connector (not shown). Further, as best seen in FIG. 5, which illustrates a bottom perspective view of connector shroud 122, groove 133 may generally extend about a perimeter of connector shroud 122, thereby allowing for sealing the entire perimeter with an adhesive or glue. Further, a plurality of engagement features 160 may be provided within groove 133, each of which provide a friction fit with housing 102, e.g., tongue 134, thereby securing connector shroud 122 to housing 102 in the absence of an adhesive or sealant, or while an adhesive or sealant is drying after application. Further, device 100 may be generally sealed about interior volume A of housing 102, pins 108, filter assembly 114, and connector shroud 122, thereby further protecting interior components of device 100, e.g., PCB 105, from external contaminants. For example, a silicone sealant (not shown) may be provided about pins 108, for example at interfaces between the second portions 112 of pins 108 and circuit board 116, between the first portions 110 of pins 108 and connector shroud 122, between capacitors 118 and circuit board 116, and between circuit board 116 and external surface 106 of housing 102. Further, housing 102 may itself be sealed, at least about interior volume A, with sealants, gaskets, etc. Accordingly, interior volume A and connector header assembly 104 are generally sealed, providing an electrical connection between PCB 105 and a mating connector (not shown) that is resistant to damage or fouling from external contaminants, e.g. moisture, dirt, etc.

Figure 6:
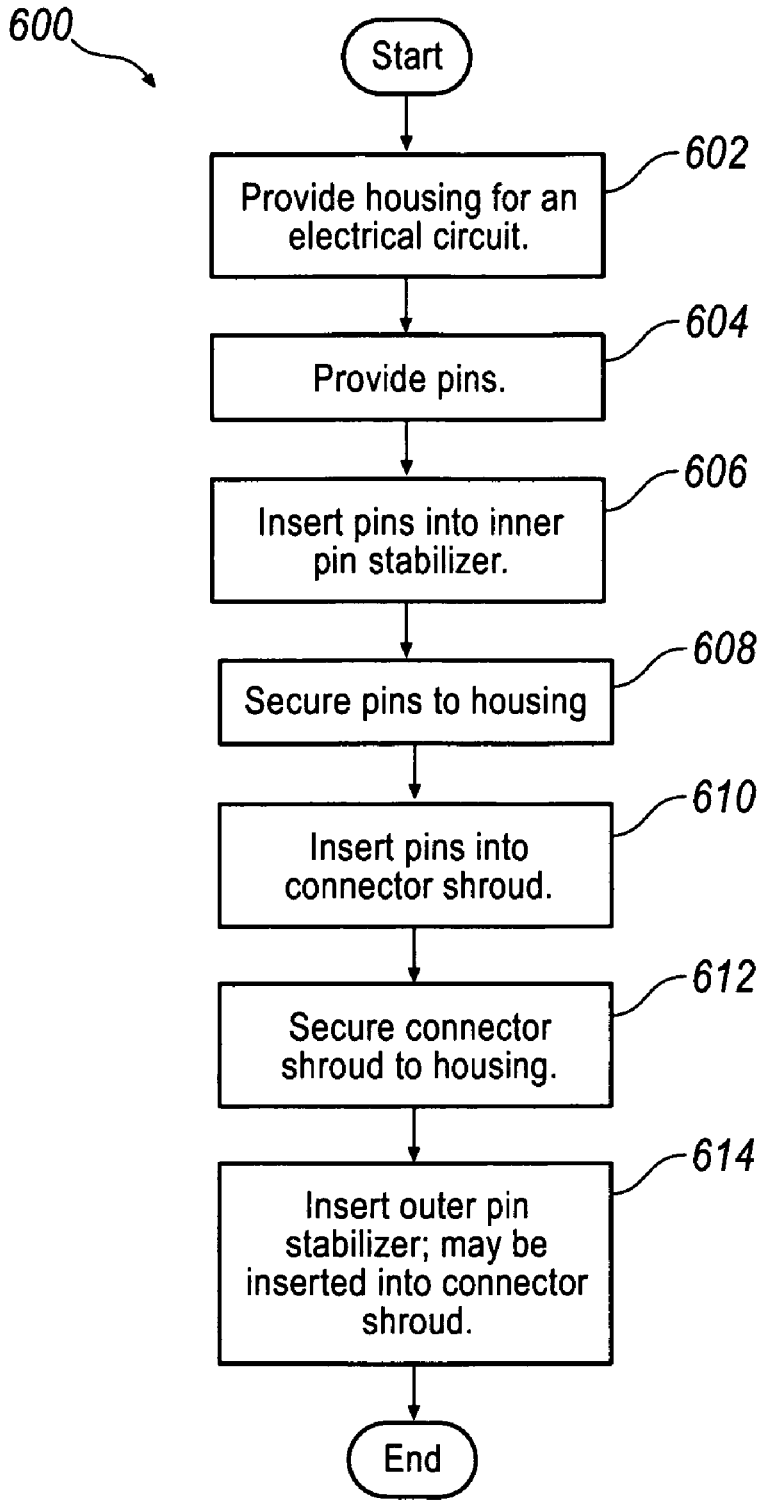
FIG. 6 is a process flow diagram for manufacturing an exemplary filtered connection header.

Proceeding now to FIG. 6, an exemplary process 600 for assembling an electrical device 100 will be described. Process 600 begins at step 602, where a housing is provided for an electrical circuit. For example, as described above, a housing 102 may be provided for a PCB 105. Housing 102 may include an interior volume A that generally protects PCB 105, and secures PCB 105 within housing 102. Process 600 then proceeds to step 604.

In step 604, a plurality of pins is provided. For example, as described above, pins 108 may be provided that include a first portion 110 and a second portion 112 that is oriented generally orthogonal to the first portion 110. Pins 108 may be initially straight, and bent to form first and second portions 110, 112. Pins 108 may advantageously be provided in bent form prior to insertion to a filter assembly 114, to reduce damage to filter assembly 114 that may occur during a pin ending process, as will be described further below. Process 600 may then proceed to step 606.

In step 606, the first portion 110 of pins 108 are inserted into an inner pin stabilizer. For example, as described above, first portions 110 of pins 108 may be inserted into apertures 126*a* provided in an inner pin stabilizer 128. Inner pin stabilizer 128 generally aligns the first portions of pins 108 and maintains proper spacing therebetween for engagement with second apertures 126*b* of outer pin stabilizer 130 and/or a mating connector (not shown) associated with connection header assembly 104. Process 600 then proceeds to step 608.

In step 608, pins 108 are secured to housing 102. For example, as described above, pins 108 may be inserted into a filter assembly 114 that is secured to housing 102, such that the pins are generally also secured to housing 102. For example, filter assembly 114 and/or pin block 120 may be secured to an external surface 106 that is adjacent interior volume A of housing 102. Securement of filter assembly 114 to an external surface of housing 102, e.g., external surface 106, generally allows filter assembly 114 to be secured to housing 102 from outside interior volume A. In other words, filter assembly 114 may be assembled to housing 102 from an upper side of housing 102, generally opposite interior volume A. Further, assembly of filter assembly 114 to housing 102 from an upper side of housing 102 generally allows pins 108 to be inserted to circuit board 116 prior to bending pins 108, at least where pins 108 are formed by bending pins that are initially generally straight. Advantageously, bending and inserting pins 108 to circuit board 116 prior to securement of circuit board 116 to housing 102 may reduce any damage, e.g., strain between circuit board 116 and grounding posts 107 and/or housing 102, that could occur to circuit board 116 if pins 108 are bent after the pins 108 are inserted to the circuit board 116 and the circuit board 116 is secured to housing 102. In other words, assembling pins 108 to circuit board 116 prior to securement of circuit board 116 to housing 102 may reduce damage to circuit board 116 that may result from strain exerted upon circuit board 116 by the pin bending process. Process 600 then proceeds to step 610. Other methods of securing pins 108 to housing 102 may be employed, such as where a filtered connection header is not necessary. For example, a pin block 120 may be provided that is secured directly to external surface 106 of housing 102 and retains second portions 112 of pins 108. Process 600 then proceeds to step 610.

In step 610, pins 108 are inserted into a connector shroud 122. For example, as described above, connector shroud 122 is assembled onto housing 102, such that first portions 110 of pins 108 are received at a rearward end 122*b* of connector shroud 122. Process 600 may then proceed to step 612, where connector shroud 122 is secured to housing 102. Connector shroud 122 may advantageously allow for a dual direction assembly while being secured to housing 102. More specifically, connector shroud 122 may receive the ends of first portion 110 of pins 108 and be moved rearwardly in a first direction that is generally parallel to first portion 110 of pins 108. Connector shroud 122 is moved rearwardly in this first direction until groove 133 is located generally directly above tongue 134 of housing 102. Groove 133 may include an extending portion 136 that contacts tongue 134 when connector shroud 122 is positioned such that groove 133 and tongue 134 are aligned, prior to moving connector shroud 122 downward to fully seat tongue 134 within groove 133. Accordingly, extending portion 136 provides a positive contact between connector shroud 122 and housing 102, thereby generally ensuring connector shroud 122 is not misaligned with housing 102. Connector shroud 122 may then be moved in a second direction, generally downwardly and/or generally orthogonal to the first direction, thereby seating tongue 134 of housing 102 within groove 133 of connector shroud 122. The dual direction assembly generally allows for a robust assembly of connector shroud 122 to housing 102, especially with the angled orientation of pins 108. Further, as described above, connector shroud 122 may be provided with a groove 133 that mates with a tongue 134 of housing 102. Further, an adhesive or sealant may be provided within groove feature of connector shroud 122 and/or upon tongue 134, thereby generally sealing an interface between connector shroud 122 and housing 102, and further providing a generally sealed interface between an electrical device contained within housing 102 and a mating connector (not shown) received by connector shroud 122. Process 600 may then proceed to step 614.

In step 614, an outer pin stabilizer is inserted into a forward end of a connector shroud 122. For example, as described above, outer pin stabilizer 130 may generally be received in a forward end 122*a* of connector shroud 122, and slid in a generally rearward direction, e.g., parallel to first portions 110 of pins 108, within connector shroud 122. Outer stabilizer 130 is moved rearward until the outer pin stabilizer 130 receives the first portion 110 of pins 108, and subsequently the inner pin stabilizer 128. Inner pin stabilizer 128 thus advantageously aligns the first portions 110 of pins 108 for receipt of the first portions 110 within apertures 126*b* of outer pin stabilizer 130. Outer pin stabilizer 130 may be generally secured within connector shroud 122 by any positive engagement feature, friction fit, snap-fit features, or the like.

Accordingly, a device 100 and a process 600 for assembling the device 100 are provided that allow for a generally low profile of device 100, and in particular of connection header assembly 104. Further, device 100 and process 600 allow for simplified assembly of connection header assembly 104 to housing 102.

Reference in the specification to "one embodiment" or "an embodiment" means that a particular feature, structure, or characteristic described in connection with the embodiment is included in at least one embodiment. The phrase "in one embodiment" in various places in the specification does not necessarily refer to the same embodiment each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. An electrical device, comprising:

a housing configured to receive an electrical circuit, said housing defining an interior volume for the electrical circuit and an external surface adjacent said interior volume; and a connection header assembly secured to said housing, including:

a plurality of electrical pins, each of said pins including a first portion and a second portion, said second portion oriented generally orthogonal to said first portion of said pins, said second portion of said pins extending into said housing to contact the electrical circuit; and a filter assembly receiving said second portion of said pins, said pins extending into said interior volume of said housing, said filter assembly secured to said external surface of said housing and configured to filter a signal transmitted through said pins.

2. The electrical device of claim 1, further comprising a connector shroud secured to said housing, said connector shroud receiving said first portion of said pins for engagement with a mating connector at a forward end of said connector shroud, said connector shroud including a pin stabilizer having a plurality of apertures, said apertures receiving said first portion of said pins.

3. The electrical device of claim 2, wherein said pin stabilizer includes an inner stabilizer defining said apertures and receiving said pins, and an outer stabilizer receiving said inner stabilizer, said outer stabilizer secured to said connector shroud.

4. The electrical device of claim 3, wherein one of said inner and outer stabilizers includes an alignment surface configured to align said inner stabilizer within said outer stabilizer when said outer stabilizer is inserted into said connector shroud.

5. The electrical device of claim 4, wherein said alignment surface is angled relative to a face of said outer stabilizer, thereby guiding said inner stabilizer into said outer stabilizer when said inner stabilizer is inserted into said outer stabilizer.

6. The electrical device of claim 1, wherein said filter assembly includes a circuit board and at least one capacitor mounted on said circuit board and disposed within said interior volume of said housing.

7. The electrical device of claim 1, wherein said filter assembly includes a pin block receiving said second portion of said pins.

8. An electrical device, comprising:

a housing configured to receive an electrical circuit; and a connection header assembly secured to said housing, including:

a plurality of electrical pins, each of said pins including a first portion and a second portion, said second portion oriented generally orthogonal to said first portion of said pins, said second portion of said pins extending through said housing to contact the electrical circuit; and a connector shroud secured to said housing, said connector shroud including a pin stabilizer received within a forward end of said connector shroud and having a plurality of apertures, said apertures receiving said first portion of said pins for engagement with a mating connector at said forward end of said connector shroud.

9. The electrical device of claim 8, wherein said pin stabilizer includes an inner stabilizer defining said apertures and receiving said pins, and an outer stabilizer receiving said inner stabilizer, said outer stabilizer secured to said connector shroud.

10. The electrical device of claim 9, wherein one of said inner and outer stabilizers includes an alignment surface configured to align said inner stabilizer within said outer stabilizer when said outer stabilizer is inserted into said connector shroud.

11. The electrical device of claim 10, wherein said alignment surface is angled relative to a face of the other of said inner and outer stabilizers, thereby guiding said inner stabilizer into said outer stabilizer when said inner stabilizer is inserted into said outer stabilizer.

12. The electrical device of claim 8, further comprising a filter assembly receiving said second portion of said pins and configured to filter a signal transmitted through said pins.

13. The electrical device of claim 12, wherein said filter assembly is secured to an external surface of said housing.

14. The electrical device of claim 12, wherein said filter assembly includes a circuit board and at least one capacitor mounted on said circuit board and disposed within an interior volume of said housing.

15. The electrical device of claim 12, wherein said filter assembly includes a pin block receiving said second portion of said pins.

16. A method of assembling an electrical device, comprising:

providing a housing for an electrical circuit;

providing a plurality of pins, each of said pins having first and second portions, said first portions oriented generally orthogonally to said second portions;

inserting said first portion of said pins into an inner pin stabilizer;

securing said pins to said housing; and inserting said inner pin stabilizer into a connector shroud.

17. The method of claim 16, further comprising securing said connector shroud to said housing.

18. The method of claim 16, further comprising inserting an outer pin stabilizer into a forward end of said connector shroud, wherein said outer pin stabilizer receives said first portion of said pins and said inner pin stabilizer.

19. The method of claim 16, wherein providing said pins includes bending generally straight pins to form said first portions oriented generally orthogonally from said second portions.

* * * * *